US005618141A

United States Patent [19]

Field

[11] Patent Number: 5,618,141

[45] Date of Patent: Apr. 8, 1997

[54] MODULAR MERCHANDISE SIGNAGE SYSTEM

[76] Inventor: Steven V. Field, 3031 Danalda Dr., Los Angeles, Calif. 90064

[21] Appl. No.: 430,201

[22] Filed: Apr. 26, 1995

[51] Int. Cl.[6] ..... G09F 3/18; G09F 15/00

[52] U.S. Cl. ..... 40/606; 40/607; 248/207; 403/375

[58] Field of Search ..... 40/606, 607, 152.1, 40/611; 248/207, 214; 403/375, 3

[56] References Cited

U.S. PATENT DOCUMENTS

| | | | |
|---|---|---|---|
| 1,650,177 | 11/1927 | Arnold | 40/607 |
| 2,050,136 | 8/1936 | Tucker et al. | 40/152.1 |
| 2,112,583 | 3/1938 | Tucker et al. | 40/152.1 |
| 2,913,840 | 11/1959 | Joseloff | 40/607 X |
| 3,086,658 | 4/1963 | Palmer | 211/50 |
| 3,820,262 | 6/1974 | Dewsnap | 40/10 D |
| 3,956,837 | 5/1976 | Itano | 40/152.1 |
| 4,144,664 | 3/1979 | De Korte | 40/609 |
| 4,165,572 | 8/1979 | Sussman | 40/10 D |
| 4,242,817 | 1/1981 | Ballard | 40/152.1 |
| 4,442,617 | 4/1984 | Frye et al. | 40/152.1 |
| 4,496,127 | 1/1985 | Nelson | 248/441.1 |
| 4,594,802 | 5/1986 | Field | 40/10 D |
| 4,726,132 | 2/1988 | Ernest | 40/10 D |
| 4,790,093 | 12/1988 | Ernest et al. | 40/661 |

FOREIGN PATENT DOCUMENTS

| | | | |
|---|---|---|---|
| 3319828 | 12/1983 | Germany | 40/607 |

OTHER PUBLICATIONS

Southern Imperial, Inc. Display Catalog, pp. 83–85, Sign Holding & Display Systems and Modular Signholder Bases & Systems (no date).

Dandee Catalog, pp. 65 and 66, Cardholders, Clamps & bases and Plexi Cardholders (no date).

JPM Catalog, p. 83, Stems, Bases & Clamps (no date).

*Primary Examiner*—Kenneth J. Dorner
*Assistant Examiner*—Cassandra Davis
*Attorney, Agent, or Firm*—Stetina Brunda & Buyan

[57] ABSTRACT

A modular merchandise signage system has a sign holder and a base removably attachable at a plurality of different orientations to the sign holder. The base comprises a clip specifically configured to attach the base to a hang bar. The sign holder and the base are configured to attach to one another at a plurality of different orientations with respect to one another.

3 Claims, 5 Drawing Sheets

MODULAR MERCHANDISE SIGNAGE SYSTEM

FIELD OF THE INVENTION

The present invention relates generally to signage and more particularly to a modular merchandise signage system generally comprising a sign holder and a base removably attachable to the sign holder. The base comprises a clip which is specifically configured to attach the base to a garment rack hang bar.

BACKGROUND OF THE INVENTION

Merchandise displays commonly use signage devices to attract the attention of potential customers thereto and also to provide information, e.g., price, etc., about the merchandise being sold.

Such signage devices frequently utilize a sign holder which maintains a display card or the like in a desired orientation so as to facilitate viewing thereof. A base is typically attached to the sign holder for mounting the display in the desired orientation in relation to a desired surface or other structure.

One example of such a contemporary signage device is that disclosed in U.S. Pat. No. 4,790,093, issued to Ernest et al. on Dec. 13, 1988. The Ernest et al. device comprises a two-piece transparent plastic sign holder attached to a circular, planar base via an elongate extension member. The two-piece sign holder is separable so as to facilitate the placement of a display card therebetween.

However, the Ernst et al. device is suitable for use only upon substantially flat, generally horizontal surfaces. Additionally, no provision is made for changing the orientation of the sign holder relative to the base, as would be desirable particularly in those instances wherein it is necessary to permanently affix (via nails, screws, staples, adhesive, etc.) the base to the surface upon which the base rests.

It is frequently desirable to permanently affix such a signage device to the surface upon which it is mounted so as to prevent undesirable re-orientation thereof, as frequently occurs when shoppers inadvertently bump into or otherwise mishandle the signage device. Such affixation of the base of the signage device to the surface thus mitigates undesirable movement of the sign in the event of such occurrences. Also, affixing the base to such a surface facilitates the use of the signage device upon non-horizontal surfaces, such as vertical walls.

However, permanent mounting of the Ernst et al. device must be done with consideration as to any future desired orientations thereof since the sign holder is not adjustable relative to the base. As those skilled in the art will appreciate, the utility of such a device is substantially restricted, since re-orientation thereof would require detachment of the base from the surface to which it is mounted, potentially resulting in substantial damage to the device or complete destruction thereof.

Another example of a contemporary signage device is disclosed in U.S. Pat. No. 4,144,664 issued to De Korte on Mar. 20, 1979. The De Korte device comprises a two-part sign holder which is formed directly to the base thereof. The base is configured for attachment to a planar surface and it incorporates holes configured for mounting screws such that the use thereof is not constrained to horizontal surfaces. As such, the De Korte device may be mounted to a wall or other vertical surface.

Neither the Ernst et al. or the De Korte devices are suitable for mounting upon a variety of different, irregular, commonly utilized merchandise display surfaces. Rather, both the Ernst et al. and the De Korte devices are clearly intended to be placed upon a generally planar surface. More particularly, the prior art signage devices are not suitable for mounting upon garment racks or slotted uprights.

As such, although contemporary signage devices have proven generally suitable for their intended purposes, they possess inherent deficiencies which detract from their overall effectiveness and utility in the marketplace. Thus, in view of the shortcomings of the prior art, it is desirable to provide an improved merchandise signage system which facilitates the mounting of a sign holder to garment racks and/or slotted uprights. It is also desirable to provide a merchandise signage system which facilitates easy re-orientation of the sign holder relative to the base thereof so as to accommodate viewing of the sign holder from various different desired locations.

SUMMARY OF THE INVENTION

The present invention specifically addresses and alleviates the above-mentioned deficiencies associated with the prior art. More particularly, the present invention comprises a modular merchandise signage system comprising a sign holder and a base removably attachable to the sign holder. The sign holder comprises a clip which is specifically configured to attach the base to a hang bar of a garment rack.

The sign holder and the base are configured to attach to one another at a plurality of different orientations with respect to one another. The sign holder may easily be attached to a garment rack so as to provide information, e.g., price, etc., regarding the merchandise displayed via the garment rack. Thus, the sign holder may easily be positioned at a desired orientation so as to facilitate convenient viewing thereof. Those skilled in the art will appreciate the importance of orienting such signage so as to easily be viewed by the largest possible number of people.

The sign holder comprises a first multi-position sign holder attachment member and the base comprises a complimentary second multi-position sign holder attachment member. The first and second multi-position sign holder attachment members facilitate attachment of the sign holder and the base to one another at a plurality of different orientations.

The sign holder preferably comprises a female sign holder attachment member having a square opening formed therein and the base preferably comprises a complimentary male sign holder attachment member configured to be received within the female sign holder attachment member. The female and male sign holder attachment members thus facilitate attachment of the sign holder and base to one another at four different relative orientations. Those skilled in the art will appreciate that various other configurations, i.e., rectangular, triangular, hexagonal, octagonal, etc., of the complimentary female and male sign holder attachment members are likewise suitable.

The clip preferably comprises a section of U-channel sized to receive the hang bar. The U-channel defines two arms which cooperate with one another to engage and hold the hang bar. Thus, the two arms must generally be spread apart slightly to effect engagement of the hang bar, and once so engaged, the arms generally apply inward pressure to the hang bar. The two arms may be configured such that they define any desired combination of detent member and friction member. Thus, the two arms may both define either detent members or friction members and, alternatively, may define one detent member and one friction member.

Each detent member is configured to snap into place so as to engage the hang bar in a manner which prevents removal of the clip without substantially bending or otherwise deforming the detent member or the arm upon which the detent member is formed sufficiently to facilitate disengagement thereof from the hang bar. Thus, each detent member comprises a lip which snaps into place below the bottom surface of the hang bar when the clip is positioned thereon such that the lip prevents removal of the clip from the hang bar unless the detent member or arm is deformed so as to facilitate disengagement of the lip from the hang bar. Those skilled in the art will that appreciate various other detent configurations are likewise suitable.

The friction member comprises a surface which abuts or frictionally engages a portion of the hang bar, so as to cooperate with the opposing arm in a manner which holds the clip upon the hang bar. The friction member preferably comprises a flair which facilitates easy insertion of the hang bar into the clip and also comprises a contact member which abuts or frictionally contacts the hang bar. Those skilled in the art will appreciate that various other configurations of the friction member are likewise suitable.

The sign holder preferably comprises first and second panels attached to one another at the base or lowermost portion thereof. The first and second panels are preferably attached to one another via ultrasonic welding. Those skilled in the art will appreciate that various other means, i.e., adhesive bonding, thermal welding, the use of fasteners, etc., are likewise suitable for attaching the first and second panels to one another.

Alternatively, the sign holder comprises a first panel and a second panel removably attachable to the first panel. The first panel preferably has a female panel attachment member formed thereon and the second panel preferably has a complimentary male panel attachment member formed thereon such that the female panel attachment member receives the male panel attachment member so as to position the first and second panels in laminar juxtaposition to one another. The male panel attachment member preferably has a detent formed thereon so as to removably lock the first and second panel members together.

The male panel attachment member preferably cooperates with the female panel attachment member to removably attach the first and second panels to one another and also to removably attach the sign holder to the base. In the preferred embodiment of the present invention, the female sign holder attachment member and the female panel attachment member are defined by a common female member. Thus, the common female member receives both the male sign holder attachment member of the base and the male panel attachment member of the second panel. The male sign holder attachment member and the male panel attachment member cooperate with one another to define a structure complimentary in configuration to the opening formed in the common female member such that each member tends to hold the other two members in their respective positions.

Optionally, the clip is configured to attach the base to the intersection of two hang bar cross members. By configuring the clip to attach the base to such a hang bar cross member intersection, stability is added to the mounting thereof. That is, when the modular merchandise signage system of the present invention is mounted to the intersection of two cross members thereof, longitudinal movement or sliding of the clip along one cross member is prevented by the other cross member. This provides a more stable positioning of the sign holder and tends to prevent accidental or inadvertent movement thereof, as may be caused by customers inadvertently contacting the sign holder.

The clip preferably comprises a section of U-channel having two cutouts formed therein such that the U-channel receives the first cross member of the intersection and such that the second cross member passes through the cutouts. Thus, the cross member is accommodated in a manner which prevents longitudinal or sliding movement of the clip.

The base of the modular merchandise signage system of the present invention optionally comprises a stand configured so as to maintain the sign holder in an upright position. The stand preferably comprises a generally planar member such that the sign holder can easily be positioned upon a flat surface, such as a display table or the like. The stand preferably comprises a male attachment member, and the sign holder preferably comprises a female attachment member, so as to facilitate attachment of the sign holder to the stand at a plurality of relative orientations to one another, as discussed above.

Optionally, a slotted upright adapter is formed to the base for attaching the base to a slotted upright, thus further increasing the utility of the present invention. The sign holder preferably comprises a female sign holder attachment member having a square opening and the base preferably comprises a complimentary male sign holder attachment member configured to be received within the female sign holder attachment member.

The sign holder alternatively comprises a sign holder attachment member having a slot formed therein and the base preferably comprises an insert member configured to be received within the slot in the sign holder attachment member.

The sign holder of the modular merchandise signage system of the present invention optionally comprises a female sign holder attachment member having a square opening, the square opening being specifically sized to receive a garment rack vertical member. A slot is formed in the female sign holder attachment member. The slot is specifically sized to receive a garment rack horizontal member. Thus, the sign holder may easily be mounted upon the upright post or vertical member of a garment rack. The square opening in the female sign holder attachment member is preferably specifically configured to receive and frictionally engage a one-inch square garment rack vertical member.

An optional adapter is configured to be received within the female sign holder attachment member and has a square opening formed therein. The square opening in the adapter is specifically sized to receive a three-quarter inch square garment rack vertical member and comprises a slot formed therein to receive the garment rack horizontal member.

The components of the modular merchandise signage system of the present invention are preferably comprised of a polymer material and may be formed by injection molding or similar methods. Those skilled in the art will appreciate that various other materials and methods are likewise suitable.

Vacuum metalization or electroplating may be utilized to color the various components of the present invention, as desired. For example, chrome electroplating may be utilized to provide an attractive metallic finish to all of the components except for the first and second panels which must remain transparent to facilitate viewing of the sign held thereby.

These, as well as other advantages of the present invention will be more apparent from the following description and drawings. It needs to be understood that changes in the specific structure shown and described may be made within the scope of the claims without departing from the spirit of the invention.

DETAILED DESCRIPTION OF THE PREFERRED EMBODIMENT

The detailed description set forth in connection with the appended drawings is intended as a description of the invention, and is not intended to represent the only form in which the present invention may be constructed or utilized. The description sets forth the functions and sequences for constructing and operating the invention in connection with the illustrated embodiments. It is to be understood, however, that the same or equivalent functions and sequences may be accomplished by different embodiments that are also intended to be encompassed within the spirit and scope of the invention.

The modular merchandise signage system of the present invention is illustrated in FIGS. 1–19 which depict three presently preferred embodiments of the invention.

Figure 1:
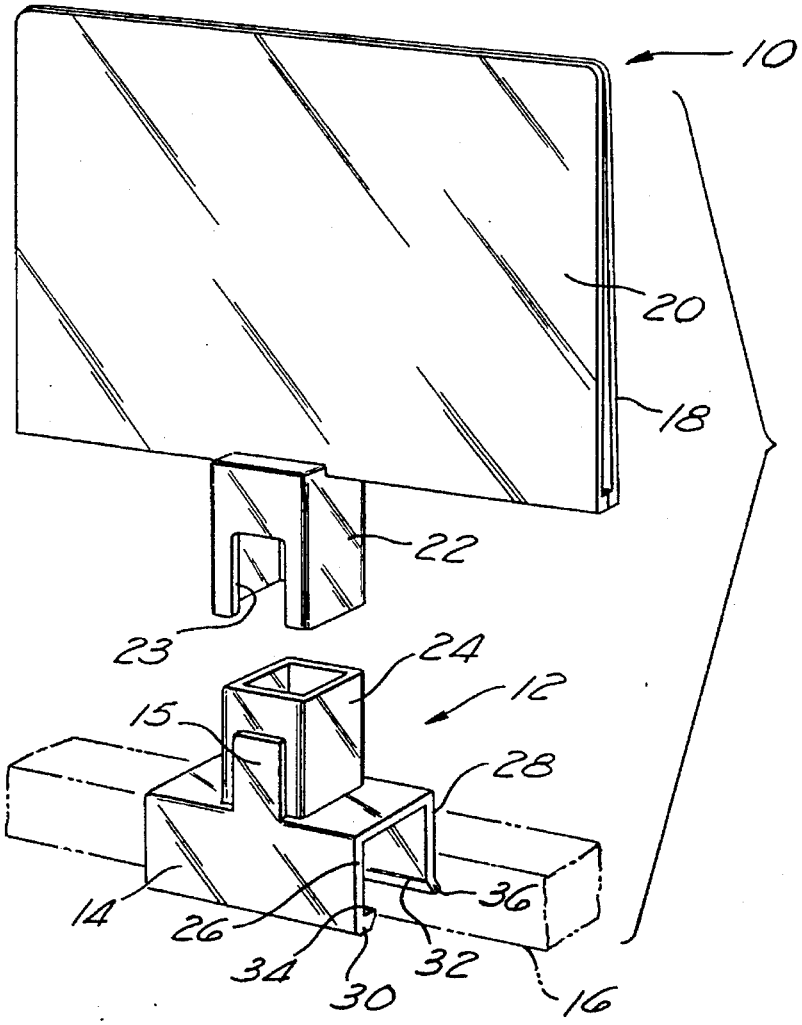
FIG. 1 is an exploded perspective view of the first embodiment of modular merchandise signage system of the present invention wherein a sign holder is removably attachable to a clip having a detent member formed upon one arm thereof and a friction member formed upon the other arm thereof.

Referring now to FIG. 1, in a first embodiment of the present invention, a sign holder 10 is removably attachable to a base 12. A first or female sign holder attachment member 22 is formed upon the sign holder 10 and configured to receive a complimentary second or male sign holder attachment member 24 formed upon the base 12. The female sign holder attachment member 22 has a cutout 23 formed in at least one side thereof, preferably in two opposed sides thereof, i.e., the front and back sides.

In the preferred first embodiment of the present invention, the female sign holder attachment member 22 is configured to have a generally square opening for receiving a generally square male sign holder attachment member 24. Thus, the sign holder 10 is attachable to the base 12 at four different orientations. Those skilled in the art will appreciate that the female sign holder 22 and male 24 attachment members may be configured to have various different shapes, e.g., triangular, hexagonal, octagonal, etc., so as to accommodate attachment of the sign holder 10 to the base 12 at differing numbers of orientations.

A clip 14 is formed upon the base 12, preferably the lower most surface thereof, so as to facilitate attachment of the base 12 to a hang bar 16 of a garment rack. The clip 14 is preferably configured as a U-channel member and comprises first 26 and second 28 arms which engage the hang bar 16. Each of the first 26 and second 28 arms is configured so as to define either a detent member 30 or a contact member 32. As shown in FIG. 1, the first arm 26 is configured so as to define a detent member 30 and the second arm 28 is configured so as to define a contact member 32.

The detent member 30 comprises a lip 34 configured so as to snap beneath the lower surface of the hang bar 16, thereby removably attaching the clip 14 thereto. In order to remove the clip 14 from the hang bar 16, the lip 34 must be moved by bending or deforming the arm 26 sufficiently so as to facilitate disengagement of the lip 34 from the hang bar 16.

The second arm 28 preferably further comprises a flair 36 formed along the lower most end thereof so as to facilitate easy attachment of the clip 14 to the hang bar 16. The second arm 26 further comprises a contact member 32 which contacts or abuts the hang bar 16.

The clip is preferably configured such that the first and second 28 arms thereof must be bent outwardly slightly so as to receive the hang bar 16. Thus, the first 26 and second 28 arms are spring biased inwardly so as to better engage and frictionally hold the hang bar 16.

Figure 2:
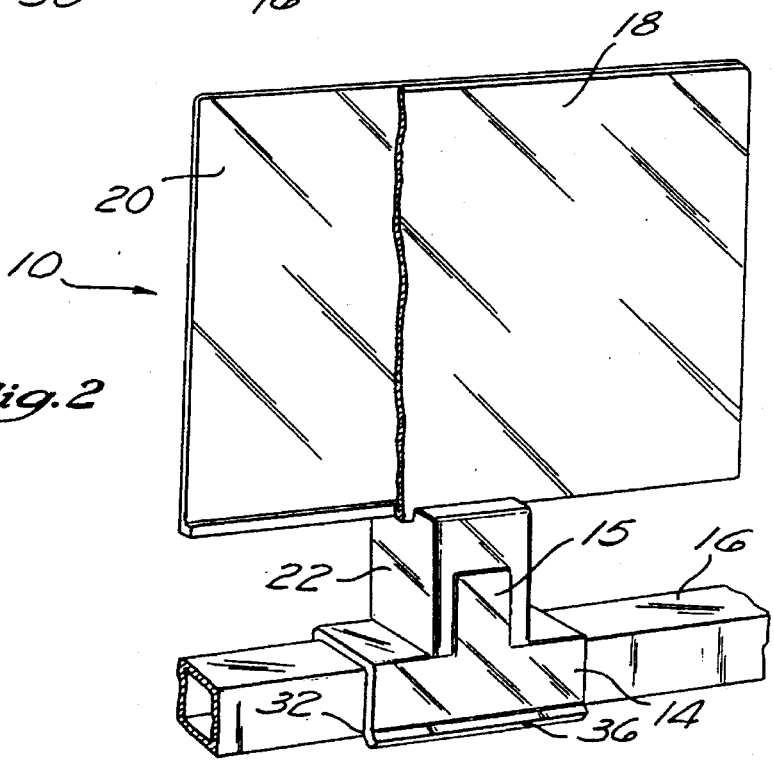
FIG. 2 is a perspective view of the modular merchandise signage system of FIG. 1 showing the sign holder thereof attached to a garment rack hang bar via the clip thereof.

A key 15, preferably formed upon both sides of the male sign holder attachment member 24, provides a clean, flush appearance by filling in the groove created by cutout 23 formed in the female sign holder attachment member 22, as shown in FIG. 2. The key 15 is preferably formed upon all of those male sign holder attachment members 24 which are utilized with a female sign holder attachment member 22 having such a cutout 23 formed therein.

Figure 5:
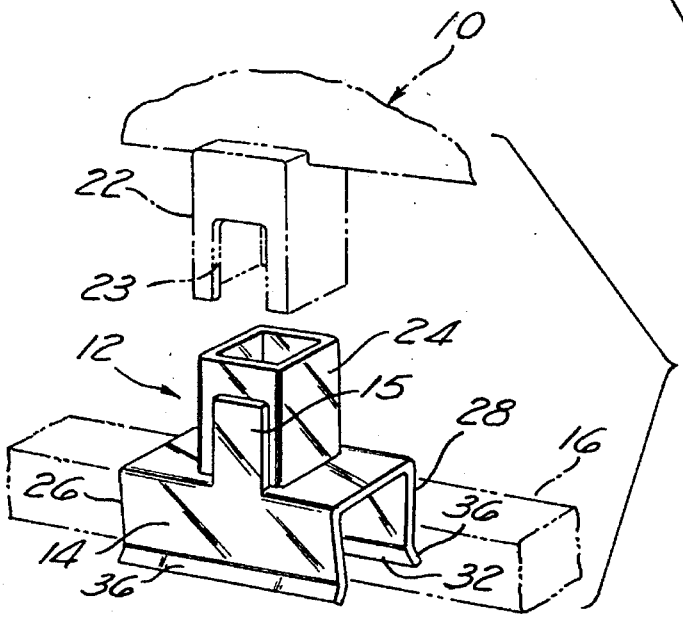
FIG. 5 is an exploded perspective view of an alternative configuration of the clip wherein both arms thereof define friction members.

Referring now to FIGS. 2 and 5, either one or both of the first 26 and second 28 arms are optionally formed to define contact members 32. Thus, in this particular configuration of the present invention, the hang bar 16 is engaged by the clip 14 via frictional forces only.

Figure 6:
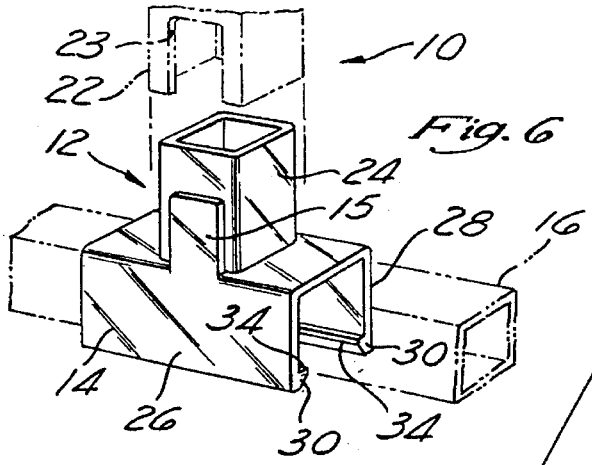
FIG. 6 is an exploded perspective view of an alternative embodiment of the clip wherein both arms thereof define detent members.
Figure 7:
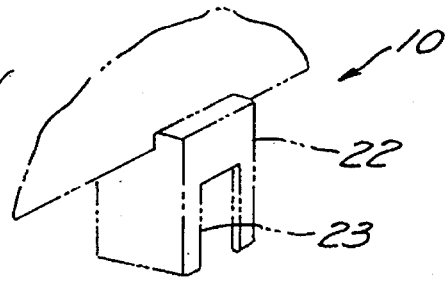
FIG. 7 is an exploded perspective view of an alternative configuration of the clip, wherein the clip is configured to accommodate two intersecting hang bar cross members.
Figure 7:
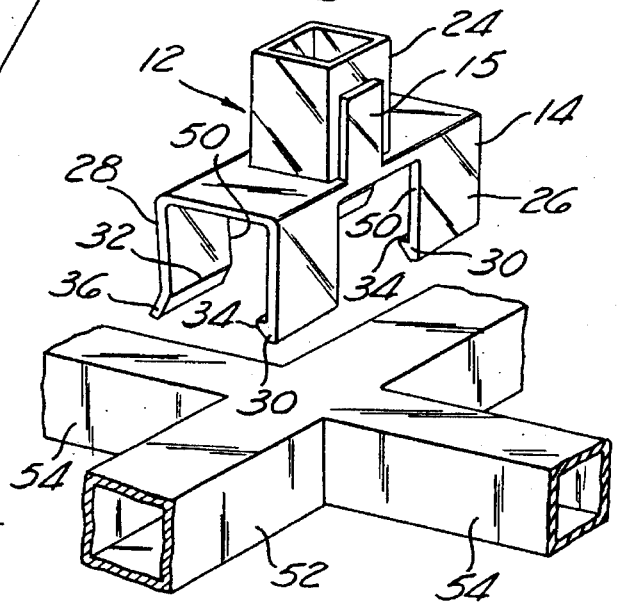
Figure 8:
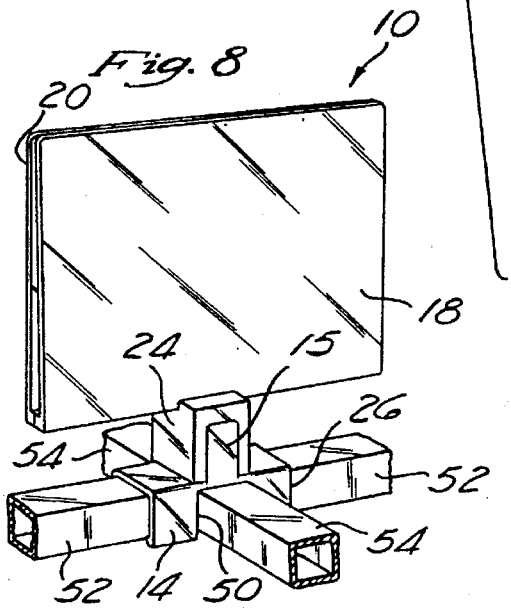
FIG. 8 is a perspective view of the modular merchandise signage system of FIG. 7.
Figure 9:
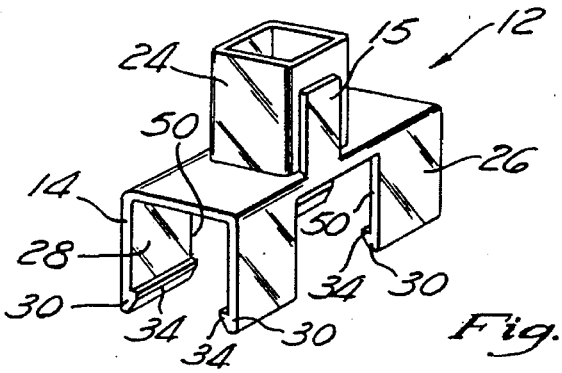
FIG. 9 is a further alternative configuration of the clip of FIGS. 7 and 8 wherein both arms thereof define detent members.
Figure 10:
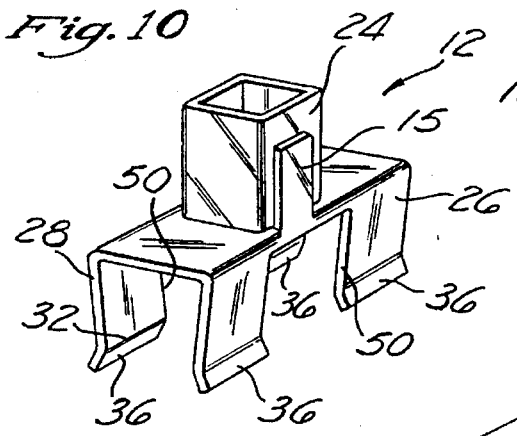
FIG. 10 is a further alternative configuration of the clip of FIGS. 7 and 8 wherein both arms thereof define friction members.

With particular reference to FIG. 6, the clip 14 is alternatively configured such that the first 26 and second 28 arms both define detent members 30. In this particular configuration of the first embodiment of the present invention, the clip 14 positively engages the hang bar 16 so as to facilitate more secure attachment thereto.

Thus, the first 26 and second 28 arms of the clip 14 may comprise any combination of detent member 30 and contact member 32 as desired.

Figure 3:
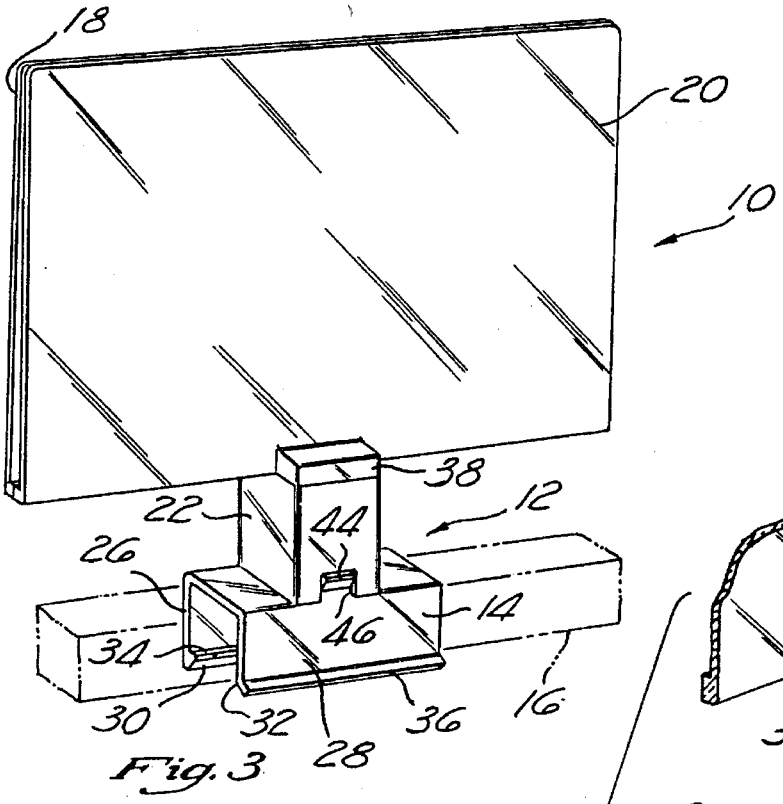
FIG. 3 is a perspective view of a second embodiment of the modular merchandise signage system of the present invention further comprising a male panel attachment member which is received within a complimentary female panel attachment member for attaching the first and second panels of the sign holder to one another.
Figure 4:
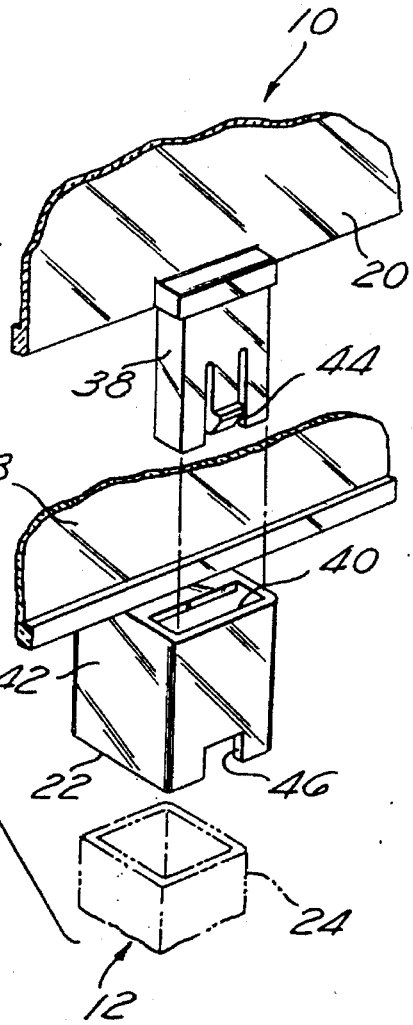
FIG. 4 is an exploded perspective view of the second embodiment of the modular merchandise signage system of FIG. 3.

Referring now to FIGS. 3 and 4, in a second embodiment of the present invention, the first 18 and second 20 panels of the sign holder 10 are removably attachable to one another such that a display card may more easily be inserted therebetween.

The sign holder 10 comprises a male panel attachment member 38 formed to the second panel 20, which is configured to be received within a generally complimentary female panel attachment member 40, formed to the first panel 18.

In the preferred embodiment of the present invention, a common female member 42 defines both the female sign holder attachment member 22 and the female panel attachment member 40. Thus, both the male panel attachment member 38 and the male sign holder attachment member 24 are received within the common female member 42 and cooperate both to hold the sign holder 10 on to the base 12 and to hold the first 18 and second 20 panels together.

A detent 44 formed to the male panel attachment member 38 attaches the second panel 20 to the first panel 18 by snapping into rectangular opening 46 formed in the common female member 42.

Thus, in use, a display card is held between the first panel 18 and second panel 20 as the first panel 18 and second panel 20 are attached to one another by inserting the male panel attachment member 13 into the female panel attachment member 40. The male sign holder attachment member 24 is immediately inserted into the female sign holder attachment member 22, so as to prevent undesirable movement of the male panel attachment member 13 and so as to effect firm attachment of the first panel 18, second panel 20, and base 12 to one another.

Referring now to FIGS. 7–10 according to an alternative configuration of the clip 14, a cutout 50 is formed in both the first 26 and second 28 arms thereof so as to facilitate attachment of the clip 14 to a garment rack comprising first 52 and second 54 cross members. The first cross member 52 is received within the U-channel defined by the clip 14 and the second cross member 54 is received in the cutout 50 formed in the first 26 and second 58 arms of the clip 14.

Thus, a sign holder 10 of the present invention is firmly attached to a garment rack such that the clip 14 cannot slide longitudinally along a hang bar.

Figure 11:
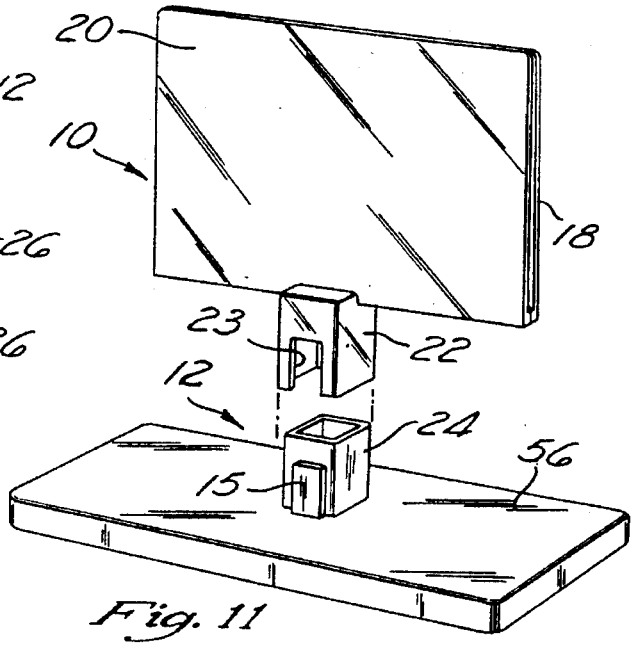
FIG. 11. is an exploded perspective view of the sign holder of FIG. 1 attached to a planar base.

Referring now to FIG. 11, the sign holder 10 may alternatively attach to a stand 56 upon which the base 12 is formed. Thus, the sign holder 10 may be conveniently placed upon any desirable horizontal surface and may optionally be attached via fasteners, e.g., nails, staples, screws, etc., to a vertical surface, as desired.

Figure 12:
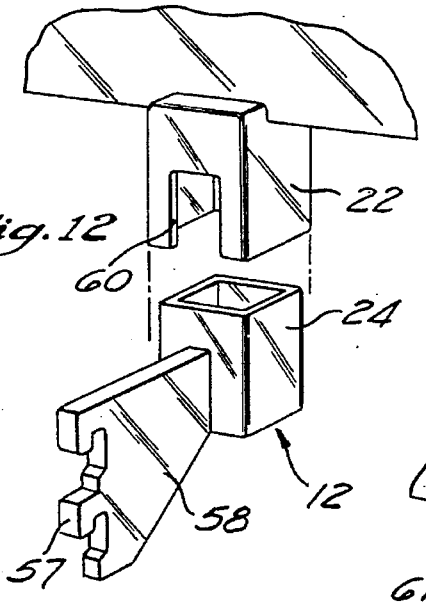
FIG. 12 is an exploded perspective view of a third embodiment of the modular merchandise signage system of the present invention wherein the sign holder is attached to a base configured to be attached to a slotted upright.
Figure 13:
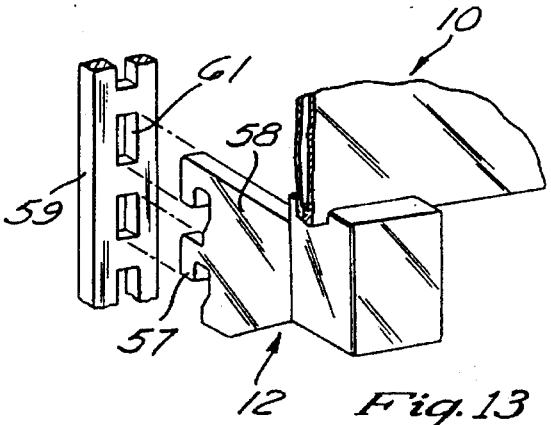
FIG. 13 is an exploded perspective view of the modular merchandise signage system of FIG. 12 illustrating attachment thereof to a slotted upright.
Figure 14:
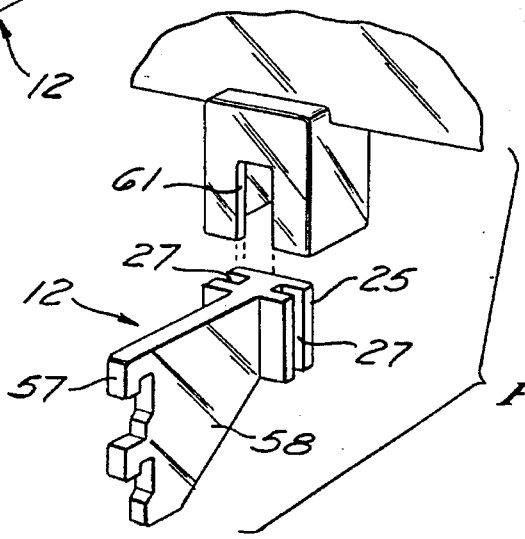
FIG. 14 is an alternative configuration of the modular merchandise signage system of FIGS. 12 and 13.

Referring now to FIGS. 12–14, a third embodiment of the present invention comprises a slotted upright adapter 58 for facilitating attachment of the sign holder 10 to a slotted upright 59. More particularly, the slotted upright adapter 58 comprises teeth 57 configured to engage slots 61 according to well known construction and methodology. Preferably, the sign holder comprises a female sign holder attachment member 22 and the base comprises a complimentary male sign holder attachment member 24 as in the first embodiment of the present invention. A slot 60 formed in the female sign holder attachment member 22 receives the slotted upright adapter 58.

Alternatively, the male sign holder attachment member 24 may be replaced with a slotted attachment member 25 having slots 27 which engage the slot 61 formed in the female attachment member 22.

Figure 15:
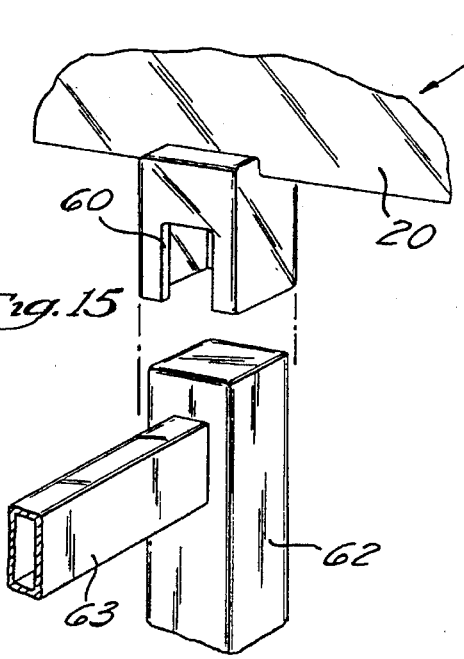
FIG. 15 is an exploded perspective view of a sign holder according to the present invention positioned for installation upon a one-inch square garment rack vertical member.
Figure 16:
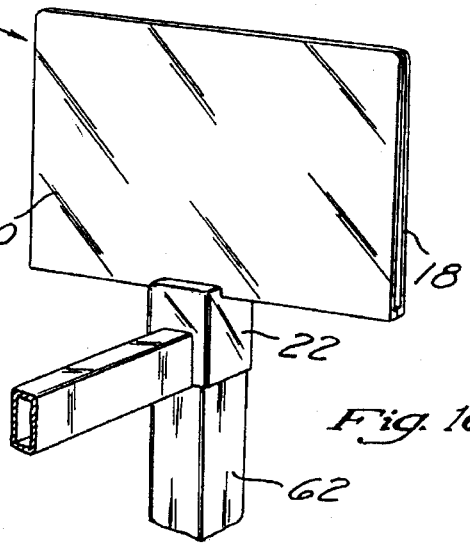
FIG. 16 is a perspective view of the sign holder of FIG. 15 installed upon the one-inch square garment rack vertical member.
Figure 17:
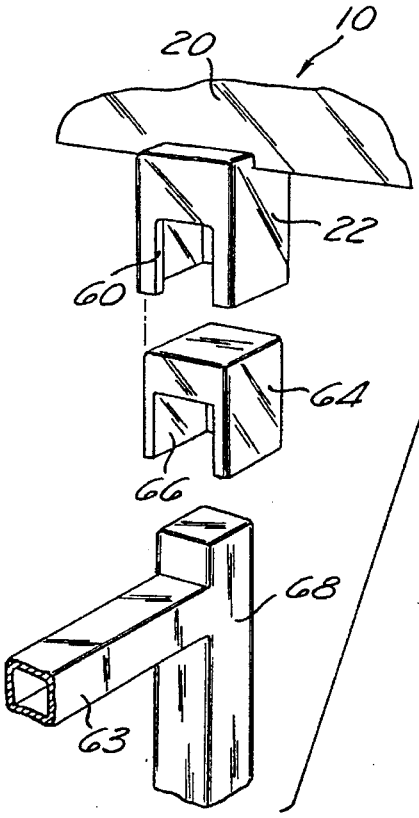
FIG. 17 is an exploded perspective view of the sign holder of FIGS. 15 and 16 wherein an adapter facilitates attachment thereof to a three-quarter inch square garment rack vertical member.

Referring now to FIGS. 15–17, the female sign holder attachment member is preferably configured to facilitate attachment to the garment rack vertical member 62 by receiving the upper most end of the garment rack vertical member 62 into the square opening thereof. The female sign holder attachment member 22 is preferably configured to have a one inch square opening formed therein so as to accommodate standard one inch square garment rack vertical members 62. Slot 60 receives horizontal member 63.

Optionally, an adapter 64 having a slot 66 formed therein may be utilized to facilitate attachment of the female sign holder attachment member 22 to a three-quarter inch square garment rack vertical member 68. The adapter 64 is thus preferably configured to have a square outer surface which is received snugly into the square opening of the female sign holder attachment member 22 and also to have a square opening formed therein for receiving the upper most end of the three-quarter inch garment rack vertical member. Slot 66 receives horizontal member 63.

Figure 18:
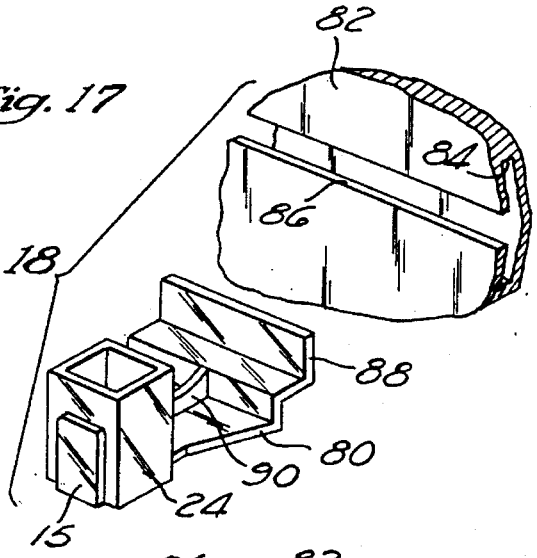
FIG. 18 is a perspective view of an alternative configuration of the third embodiment of the modular merchandise signage system of the present invention wherein the sign holder attaches to a base configured to be attached to a slatwall.
Figure 19:
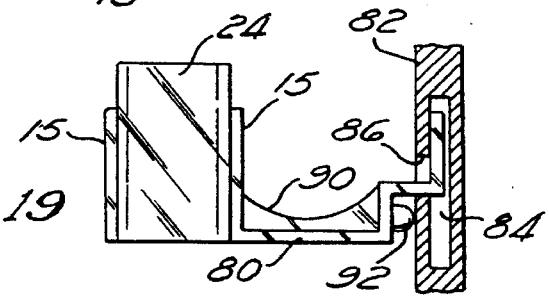
FIG. 19 is a side view of the base and attachment member of FIG. 18, also showing the slatwall in cross-section.

Referring now to FIGS. 18 and 19, an alternative configuration of the third embodiment of the present invention as illustrated. In this alternative configuration, the male sign holder attachment member 24 is formed to a slatwall adapter 80 which is configured for attachment to a contemporary slatwall 82 in a manner well known to those skilled in the art. The slatwall 82 comprises a slot 84 having an opening 86 which receives L-shaped member 88 of the slatwall adapter 80. Optional reinforcing gusset 90 provides structural support for the male sign holder attachment member 24.

One or more optional protrusions or bumps 92 are formed upon the slatwall adapter 80 so as to urge the male sign holder attachment member 24 into a substantially vertical position, thus preventing sagging thereof. Key 15 provides a clean, flush fit with female sign holder attachment member 22, as discussed above.

It is understood that the exemplary modular merchandise signage system of the present invention described herein and shown in the drawings represents only presently preferred embodiments thereof. Indeed, various modifications and additions may be made to such embodiments without departing from the spirit and scope of the invention. For example, those skilled in the art will appreciate that various different types of sign holders may be utilized. For example, rather than completely enclosing the display card, the sign holder may merely attach to the display card via a clip or the like. Additionally, various different configurations of the male and female sign holder attachment members are contemplated. Further, those skilled in the art will appreciate that the dimensions of the present invention may be varied so as to accommodate use with various different sizes of garment racks, slotted uprights, slatwalls, etc. Thus, these and other modifications and additions may be obvious to those skilled in the art and may be implemented to adapt the present invention for use in a variety of different applications.

What is claimed is:

1. A modular merchandise signage system comprising:

a) a sign holder;

b) a female sign holder attachment member formed to said sign holder, said female sign holder attachment member having a square opening, the square opening being specifically sized to receive a one-inch square garment rack vertical member;

c) a slot formed in said female sign holder attachment member, said slot being specifically sized to receive a garment rack horizontal member; and d) an adapter configured to be received within said female sign holder attachment member and having a square opening formed therein, the square opening in said adapter being specifically sized to receive a three-quarter inch square garment rack vertical member.

2. A modular merchandise signage system comprising:

a) a sign holder;

b) a female sign holder attachment member formed to said sign holder, said female sign holder attachment member having an attachment member opening specifically sized to receive any complimentarily sized garment-rack vertical member, and further having a slot specifically sized to receive any complimentarily sized garment-rack horizontal member; and c) an adapter configured to be received within said female sign holder attachment member and having an adapter opening formed therein, the adapter opening in said adapter specifically sized to receive any complimentarily sized garment-rack vertical member, with said adapter having a slot registerable with the slot of the attachment member.

3. The modular merchandise signage system as recited in claim 2 wherein the attachment member opening and adapter opening are substantially square.

* * * * *